US006318975B1

(12) United States Patent
Kost

(10) Patent No.: US 6,318,975 B1
(45) Date of Patent: Nov. 20, 2001

(54) MOTOR MOUNT ASSEMBLY

(75) Inventor: James A. Kost, Willoughby, OH (US)

(73) Assignee: The Louis Berkman Company, Steubenville, OH (US)

( * ) Notice: Subject to any disclaimer, the term of this patent is extended or adjusted under 35 U.S.C. 154(b) by 0 days.

(21) Appl. No.: 09/572,657

(22) Filed: May 16, 2000

(51) Int. Cl.[7] ..... F04B 17/00
(52) U.S. Cl. ..... 417/360
(58) Field of Search ..... 417/360, 423.15; 92/161

(56) References Cited

U.S. PATENT DOCUMENTS 4,601,378 * 7/1986 Pierce et al. ..... 417/360
5,281,878 * 1/1994 Schaeffer ..... 310/91
6,257,843 * 7/2001 Cook et al. ..... 417/360

* cited by examiner

*Primary Examiner*—Charles G. Freay
(74) *Attorney, Agent, or Firm*—Vickers, Daniels & Young

(57) ABSTRACT

A motor mount assembly for use with a hydraulic system of a snowplow. A motor mount has a mounting surface for receiving a motor and a recessed surface from which interengaging components protrude. A motor has a suitable mounting surface for mating with the motor mount and a pilot surface from which interengaging components are recessed. The proper alignment of the interengaging recesses of the motor with the complementary interengaging protrusions of the motor mount allow the mounting surfaces to abut such that the motor can be securely attached to the motor mount.

16 Claims, 5 Drawing Sheets

MOTOR MOUNT ASSEMBLY

BACKGROUND OF THE INVENTION

This invention relates to motor driven hydraulic systems, and more particularly, to a motor mounting arrangement for use on a hydraulic system which is externally affixed to a motorized vehicle, where the hydraulic system is used to manipulate a snowplow blade.

Motor driven hydraulic systems have been provided heretofore and generally as shown in Pat. No. 3,773,074 to Miceli, for example. Such hydraulic systems are comprised of a motor which is mounted to the body of a hydraulic system at a suitably designed mounting location. The motor typically drives a hydraulic pump which pressurizes the fluid within the system. The pressurized fluid is then used as a source of mechanical power for use in applications described hereinafter.

Hydraulic systems of the foregoing design are well known and regularly employed in a wide variety of applications. Many such applications incorporate this system into a motorized vehicle, where the system is used to provide mechanical power to cylinders which, in turn, manipulate an attached implement. Such applications include warehouse lift trucks, farm tractor implements, construction and earth moving equipment, and snowplow attachments. In each application, the manufacturer designs the system with a specific target for the amount of mechanical power to be output by the system. For instance, the manufacturer may want the system to have the capacity to lift a one ton object, or move five cubic yards of gravel with one push. The manufacturer will normally consider the influence of additional factors, and then design and size each of the components of the system accordingly. Such additional factors may include cost of the components, duty cycle, and conditions of use. The weight given to each factor varies from application-to-application and from manufacturer-to-manufacturer.

The conditions of use are particularly influential with regard to hydraulic systems that are externally affixed to motor vehicles for use with snowplows. Such systems are subjected to abuse which is not present in the other previously described applications. In these other applications, the hydraulic system is normally housed within one of the compartments of the vehicle or at the very least the hydraulic system is shielded by the vehicle's body. This is not so with the hydraulic system in this application, that is, one used to manipulate a snowplow blade. Here, the hydraulic system is attached to the front of a truck or other vehicle where it is exposed to extreme weather conditions. Additionally, even though plowing is done at relatively low speeds, the snowplow blade traveling across the uneven surface of a driveway or parking lot creates significant jolting, jarring and vibration throughout the entire hydraulic system. Furthermore, a hydraulic system of the foregoing description is rigidly mounted to the frame of the vehicle. This is necessary to provide the proper strength for the snowplow, but this makes the installation and removal of the heavy hydraulic system a difficult and time consuming task. As such, the system is routinely left on the vehicle year-round, even though the snowplow may have been removed at the first sign of spring. The vehicle is then used in an everyday fashion, many times including travel on highways or at highway speeds, during which time the hydraulic system mounted on the front of the vehicle, without the protection of the snowplow blade, will be subject to severe impact from stones and asphalt chips moving at highway speeds. In the other applications, the systems are installed on vehicles which do not regularly, if ever, travel at highway speeds. Furthermore, the shielding previously described for these other applications provides protection for the system in the event that it is transported at high speeds. In the end, the hydraulic system for a snow plow incurs abuses not commonly endured by other applications. For this reason, components normally used with success in other applications cannot survive in a hydraulic system for a snowplow.

The foregoing description of the conditions of use of the hydraulic system of the snowplow indicates the abusive nature of this particular application. As a result, only components with sufficient quality and qualified construction will withstand such abuse. Of particular susceptibility is the electric motor which drives the hydraulic pump. When the need eventually arises for the motor to be replaced, the repair person may, intentionally or not, replace the motor with one of lesser quality, durability and/or construction, or one of different speed or power output. This is a common occurrence because motors of any particular size are available in a wide variety of quality, construction and horsepower ranges. This greatly increases the possibility that a motor of insufficient quality, durability and/or construction will be installed on the hydraulic system, or that a motor with excessive speed or power output will be installed. Either case is potentially dangerous to the operator, and can also cause damage to the equipment or the manufacturer's reputation.

SUMMARY OF THE INVENTION

In accordance with the present invention, a motor mount assembly is provided for hydraulic systems of the foregoing character which avoids or minimizes the problems and difficulties heretofore encountered in connection with the use thereof, and which promotes and maintains the desired simplicity of structure, economy of manufacture and ease of installation found in the foregoing hydraulic systems currently in use. More particularly, the invention provides a motor mount assembly comprising a motor and a motor mount. The motor is installed on the motor mount in a traditional fashion, using a pilot diameter for proper positioning and alignment of the motor on the motor mount. Once a standard motor has been positioned as described above, the motor can then be moved axially toward the motor mount until it is fitted flush thereagainst, and can then be secured using traditional fasteners. The present invention includes the addition of complementary interengaging components on both the motor and the motor mount. When these components are present and properly aligned, the motor will be able to move axially into position against the motor mount as described above. However, when the installation of a motor lacking such components is attempted, the component on the motor mount will prevent such a motor from moving axially into the proper position against the motor mount as previously described.

The motor mount is attached to the hydraulic system at a pump housing which is another component of the hydraulic system. The pump housing harbors the pump and also contains fluid drawn from the system on route to the pump intake. As such, an additional function of a motor mount assembly according to the invention is to retain the fluid of the hydraulic system. Accordingly, the interengaging component of the motor mount is designed such that an attempt to circumvent the necessary interengagement, by removal of the component from the motor mount, will render the motor mount ineffective for retaining the fluid of the hydraulic system.

It is an outstanding object of the invention to provide a motor mount assembly on a hydraulic system of a snowplow which includes a motor and a motor mount having an interengaging arrangement to ensure against the installation of a motor having a different construction, quality or output than the hydraulic system requires.

Another object of the invention is the provision of a motor mount having an interengaging arrangement requiring a motor with a complementary interengaging arrangement for proper installation, and which is designed to dissuade efforts to defeat the interengaging feature.

Still another object of the invention is the provision of a motor mount, used in association with the hydraulic system of a snowplow, which retains fluid within the hydraulic system and provides a portion of an interengaging arrangement for ensuring the installation of a motor having a complementary interengaging arrangement, where removal of the interengaging arrangement from the motor mount will cause the release of fluid from the hydraulic system.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF PREFERRED EMBODIMENT

Figure 1:
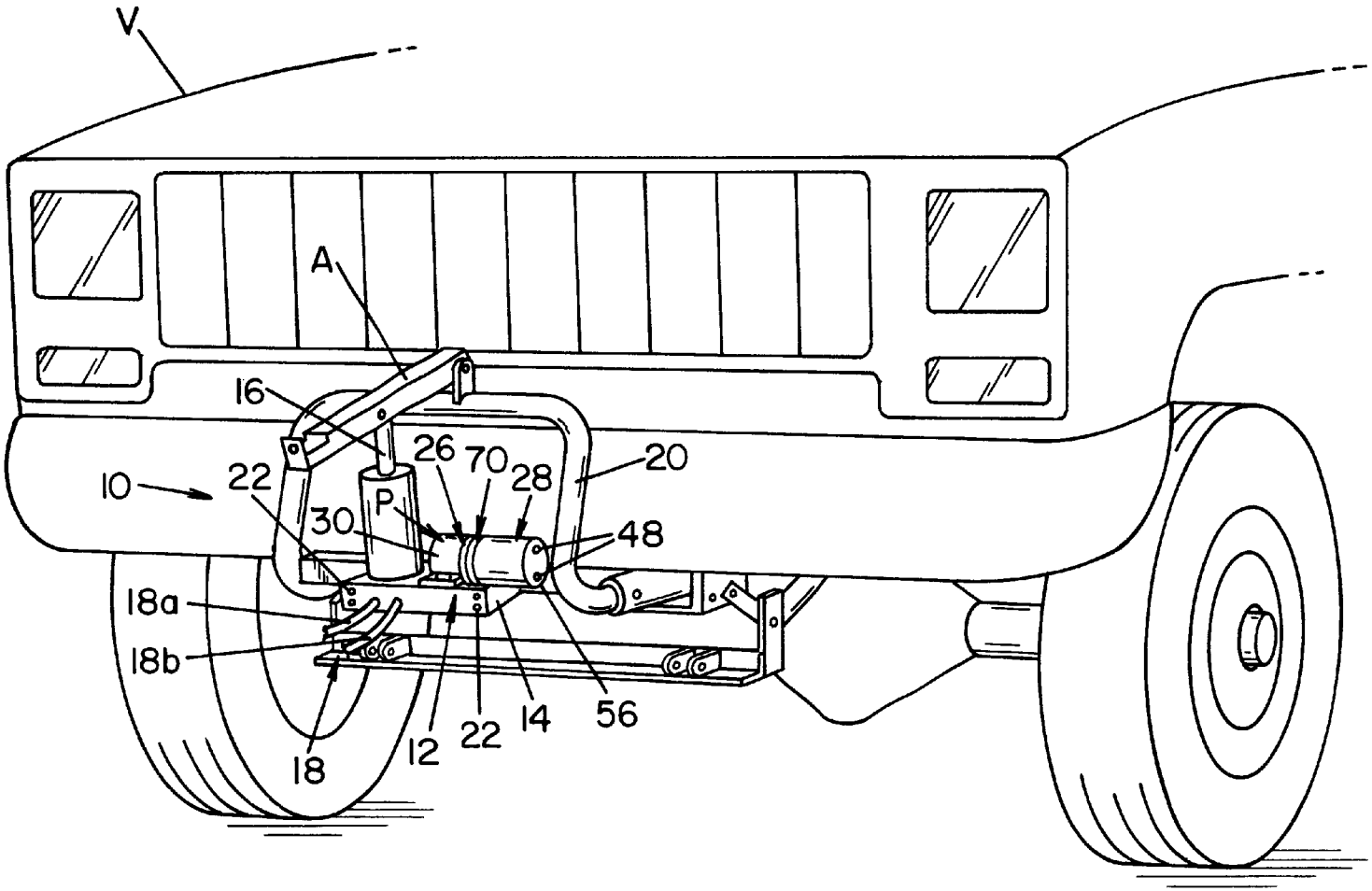
FIG. 1 is a perspective view of a hydraulic system for a snow plow which is mounted on the front of a motor vehicle.

Referring now in greater detail to the drawings, wherein the showings are for the purpose of illustrating a preferred embodiment of the invention only and not for the purpose of limiting the invention, FIG. 1 of the drawings illustrates a hydraulic system 10 which is externally affixed to a motor vehicle V, and which is used to provide mechanical power output for manipulating a snow plow (not shown), where the plow is also attached to the exterior of vehicle V. The hydraulic system 10 creates pressurized hydraulic fluid which is directed through the system to the various system outputs. The energy stored within the hydraulic fluid is then converted to mechanical power output which is used to manipulate the snowplow. The hydraulic system 10 includes a motor mount assembly 12 for taking in low pressure fluid and, using electrical energy, driving and mechanically converting the low pressure hydraulic fluid to high pressure hydraulic fluid. A reservoir 14 is provided for storing the low pressure hydraulic fluid, and a piston and cylinder arrangement 16 is adapted to receive the high pressure fluid and convert the energy therein into mechanical power output for applying a force to lift arm A which would be suitably connected to the snowplow. Hydraulic hoses 18 are suitably attached at one end to reservoir 14, and at the opposite end to one or more remote mechanical power converters, such as a piston and cylinder arrangements (not shown). Hydraulic hose 18*a* carries high pressure fluid from the motor mount assembly 12 to the remote mechanical power converter, causing the actuation thereof, and hose 18*b* returns the resulting low pressure fluid to reservoir 14. The action of the remote mechanical power converter is reversed by directing the high pressure fluid from motor mount assembly 12 to flow through hydraulic hose 18*b*, such that hose 18*a* returns the resulting low pressure fluid to reservoir 14. The direction of the hydraulic fluid is controlled by electromechanical valves (not shown) which are commonly known in the art, and will not be described further. Reservoir 14 is mounted to the frame 20 using traditional fasteners, such as bolts 22. The motor mount assembly 12 is comprised of a motor mount 26, a motor 28, and a pump P. The reservoir 14, piston and cylinder arrangement 16, hydraulic hoses 18, and pump P are all of common construction and well known in the art. Therefore, no further description of these components will be advanced.

Figure 2:
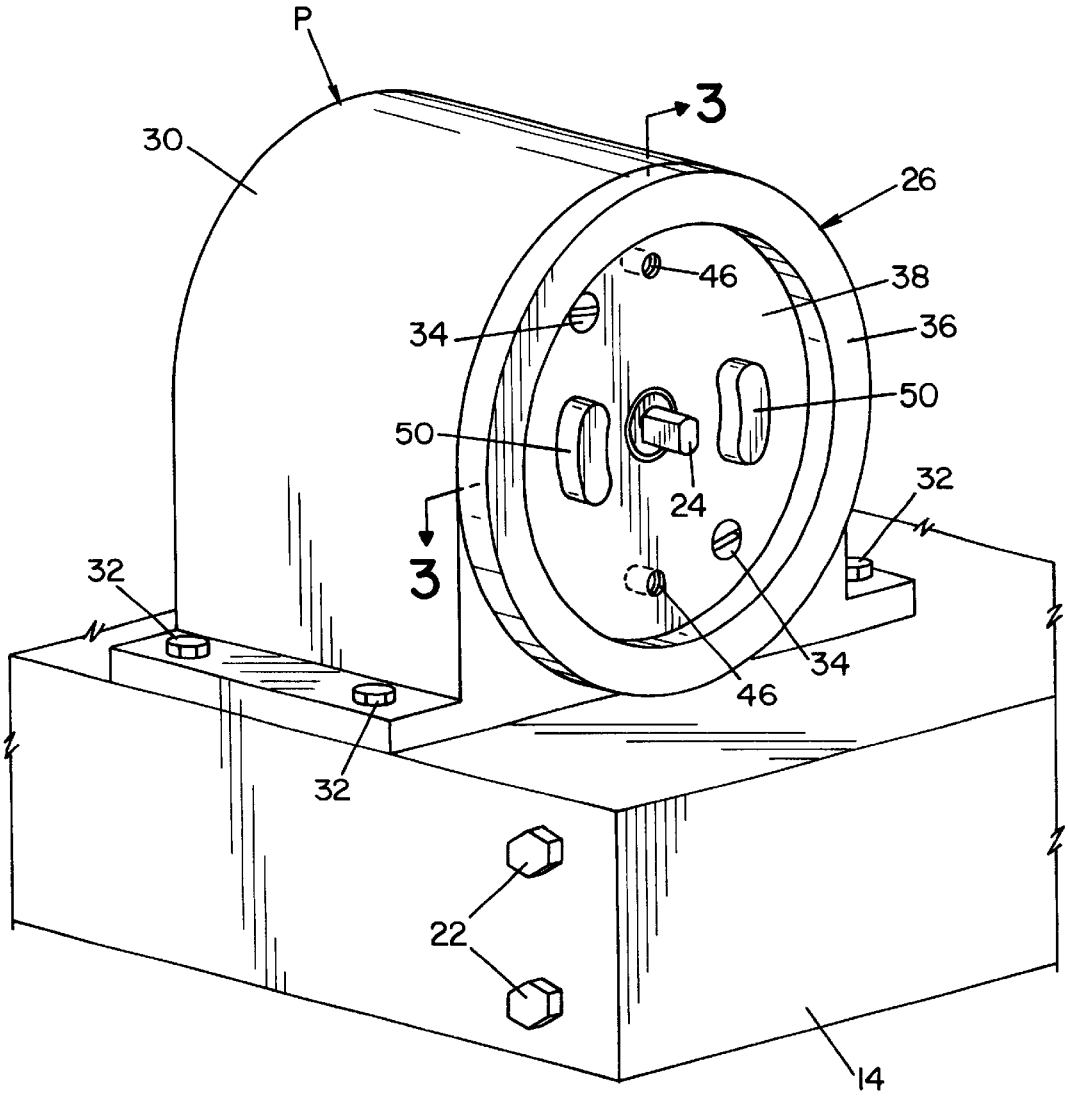
FIG. 2 is a perspective view of the pump and motor mount of a motor mount assembly in accordance with the present invention.
Figure 3:
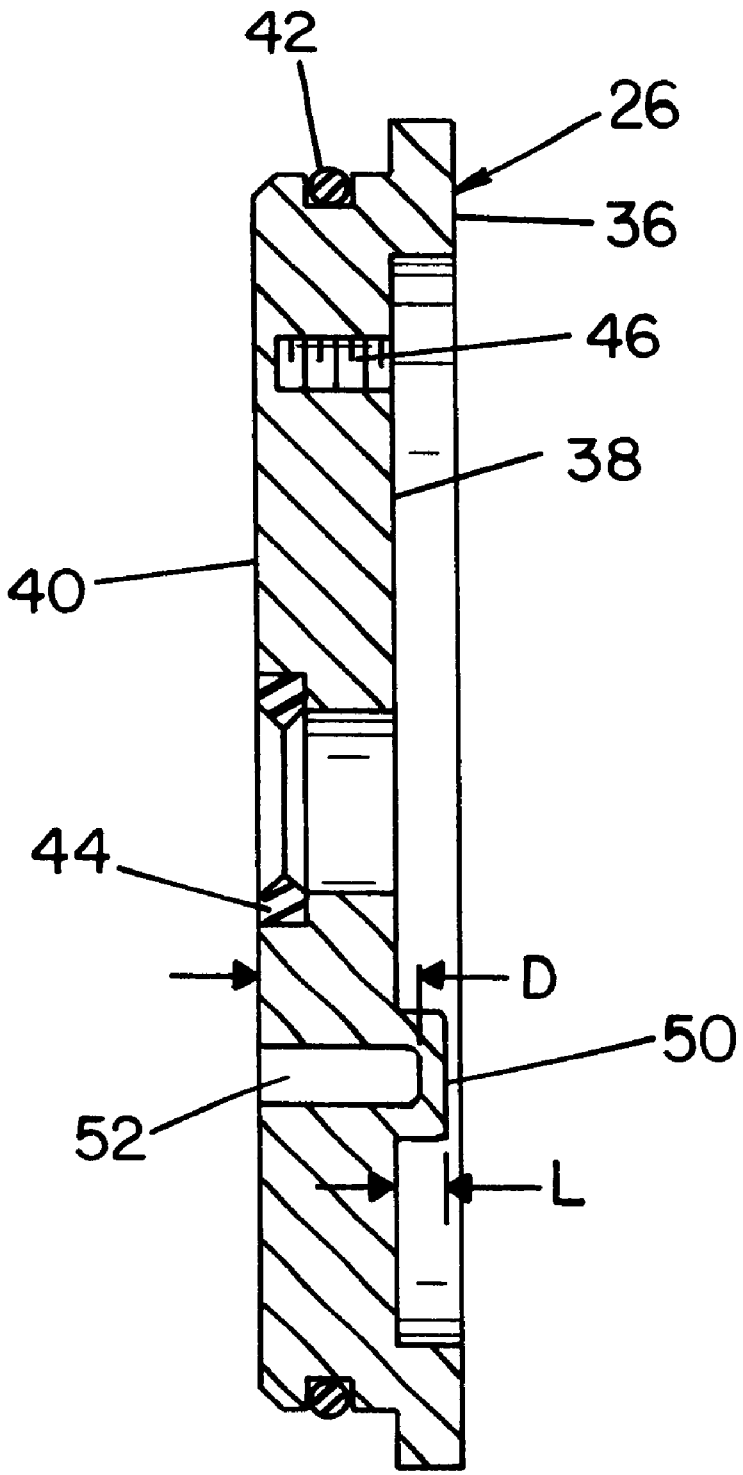
FIG. 3 is a sectional elevation view of the motor mount taken along line 3—3 in FIG. 2.

FIGS. 2–5 of the drawings illustrate assemblies and components of the hydraulic system 10. Referring now to FIGS. 2 and 3 of the drawings, the pump P includes an input shaft 24 and a pump housing 30. Pump P draws low pressure fluid from reservoir 14 into the pump housing 30 and the housing is therefore suitably interfaced with reservoir 14 to prevent leakage of the fluid, and properly secured thereto using bolts 32. Motor mount 26 acts as a cover plate for pump housing 30 and is fastened thereto using screws 34. Motor mount 26 includes a motor mounting surface 36, a base surface 38, and a back surface 40. The motor mount is positioned on pump P, such that the back surface 40 is toward pump housing 30. Motor mount 26 also includes a seal 42 positioned between the pump housing 30 and the motor mount 26 which prevents the hydraulic fluid within pump housing 30 from escaping. Motor mount 26 also includes an input shaft seal 44 positioned between the motor mount 26 and the input shaft 24 for further preventing the escape of hydraulic fluid from the pump.

The base surface 38 of motor mount 26 is recessed into the motor mount from motor mounting surface 36. Base surface 38 includes mounting holes 46 extending thereinto which are threaded to receive motor mounting bolts 48 by which the motor is attached to the motor mount and pump, as shown in FIG. 1. Bosses 50 extend a length L, from base surface 38 toward motor mounting surface 36, and are shown in FIG. 2 as being kidney-shaped, though any suitable shape or size will function for the intended purpose of the bosses as set forth hereinafter. To discourage the removal of bosses 50, cavities 52 are provided inwardly of rear surface 40 such that removal of a boss 50 will create an opening in the motor mount 26 permitting the hydraulic fluid contained thereby to escape. Cavities 52 originate on back surface 40 and project into the corresponding bosses 50 to a depth D, sufficient to extend cavities 52 to a point beyond base surface 38.

Figure 4:
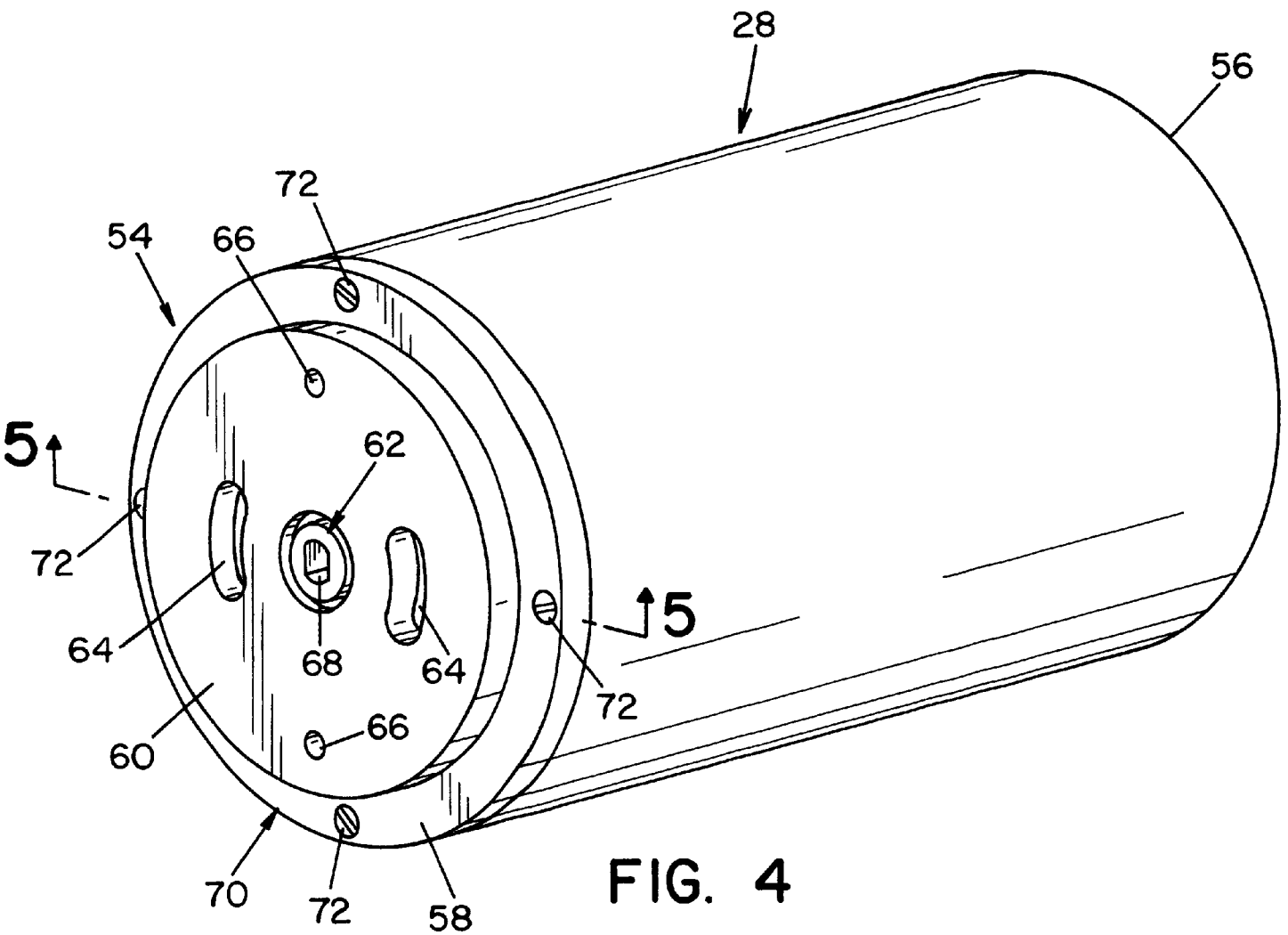
FIG. 4 is a perspective view of the motor assembly.
Figure 5:
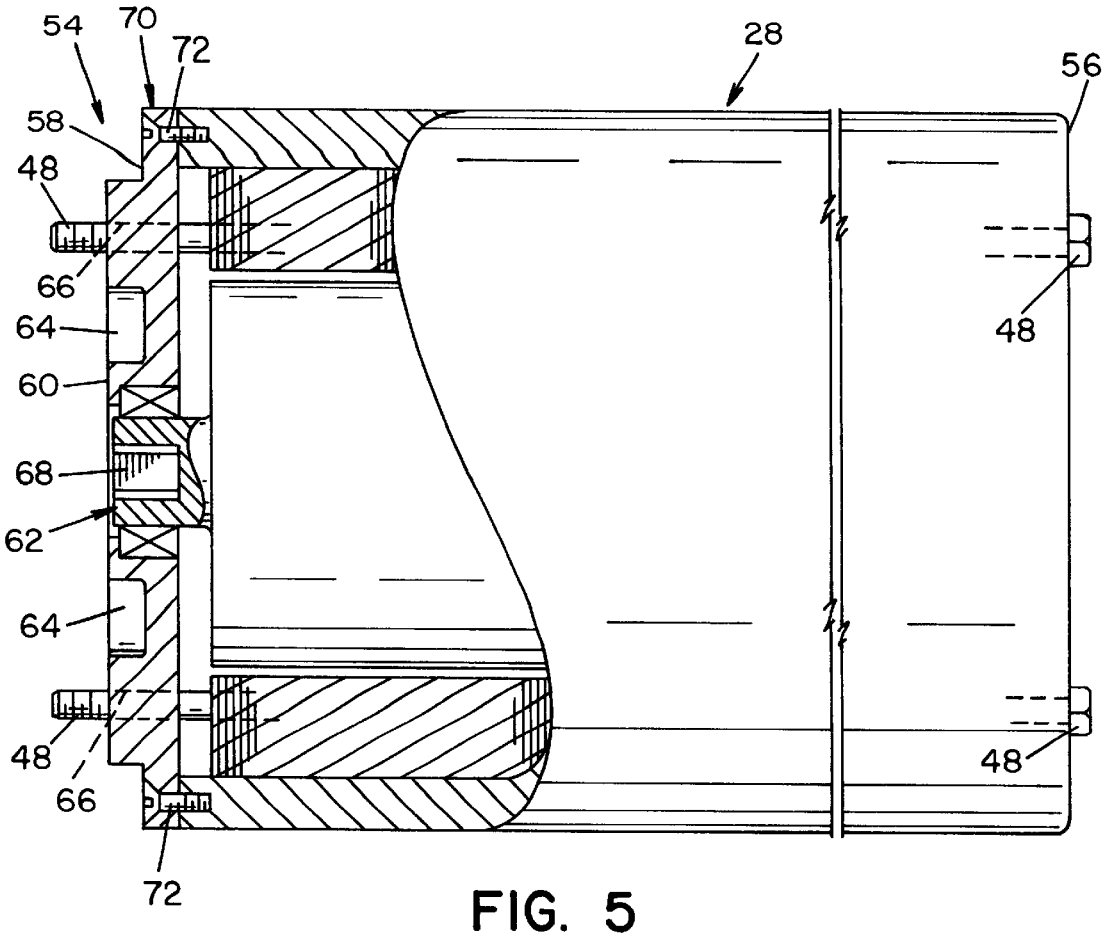
FIG. 5 is a sectional elevation view of the motor taken along line 5—5 in FIG. 4.

Referring now to FIGS. 1, 4 and 5 of the drawings, motor 28 operates on electrical power in a typical fashion well known in the art. Motor 28 includes an output end 54 and a cover end 56. Output end 54 is comprised of an end plate 70 and a motor output coupling 62 having a motor output socket 68 located therein, and of suitable size and shape to drivably receive pump input shaft 24. Motor output socket 68 also has sufficient depth to fully receive pump input shaft 24 when motor 28 is properly installed on motor mount 26. End plate 70 includes a mounting surface 58 and a pilot surface 60, and is attached to motor 28 such that pilot surface 60 is facing away from motor 28 and is attached thereto using traditional fasteners, such as screws 72. Pilot surface 60 includes bolt holes 66 extending through motor 28 to cover end 56. Pilot surface 60 also includes recesses 64 which are complementary in shape and size to bosses 50 on motor mount 26 for properly receiving bosses 50. The motor 28 is oriented for assembly with motor mount 26 such that output end 54 is facing toward the motor mount. For mounting surface 58 of motor 28 to be properly installed and mount flush against motor mounting surface 36 of motor mount 26, recesses 64 in pilot surface 60 must be properly aligned with the corresponding bosses 50 of base surface 38, and the bosses and recesses must be of complementary size and shape. Otherwise the bosses 50 projecting from motor mount 26 prevent the proper installation of motor 28. Likewise, if a motor 28 does not include recesses 64 then the motor will not be able to receive bosses 50 and therefore will be prevented from moving into position against motor mount 26, precluding proper installation thereon. As such, efforts to defeat the effect of bosses 50, and thereby permit the installation of a motor 28 of questionable suitability and having no recesses, can be expected. To discourage the removal of bosses 50, and thereby ensure that a suitable motor 28 having recesses 64 will be installed, cavities 52 extend from back surface 40 of motor mount 26 into bosses 50. As described previously, cavities 52 extend into bosses 50 to a point beyond base surface 38 so that removal of bosses 50 will cause cavities 52 to be exposed from base surface 38. The exposed cavities 52 become holes through motor mount 26, through which the hydraulic fluid retained by motor mount 26 will be allowed to escape. The importance of installing a motor of suitable power, speed, construction, and quality was discussed in the foregoing sections. It is commonly known that motor 28, as with all motors, must be properly and securely installed for safe and effective operation. This reduces the likelihood that the installation a motor 28 having no recesses 52 on a motor mount 26 having bosses 50 would be attempted. The likelihood of such an attempt is further reduced because socket 68 of motor output coupling 62 of motor 28 must be aligned with and properly receive input shaft 24 for motor 28 to be drivably installed on motor mount 26 and effectively function. When all of the components are properly aligned and interengaged, motor 28 is affixed to motor mount 26 by bolts 48 installed through bolt holes 66 entering at cover end 56 of motor 26 and extending through to and threadedly engaging threaded holes 46 in motor mount 26.

While considerable emphasis has been placed herein on structures and structural interrelationships between the component parts of the embodiment disclosed, it will be appreciated that other embodiments of the invention can be made and that many changes can be made in the embodiment illustrated and described without departing from the principles of the invention. This may include variations in the types and quantities of the fasteners shown and described, and variations in the type and configuration of seals and sealing materials shown and described. Additionally, features such the bosses 50 and the recesses 52 may be of different shape, size or quantity so long as the complementary interrelationship as shown and described is maintained. Accordingly, it is to be distinctly understood that the foregoing descriptive matter is to be interpreted merely as illustrative of the present invention and not as a limitation.

Having thus described the invention, it is so claimed:

1. A motor mount assembly for affixing an auxiliary motor to a motor vehicle, said motor mount assembly being comprised of:

a motor having a front end, a back end, a first mounting surface and a pilot surface generally parallel to said first mounting surface, said first mounting surface and said pilot surface each being toward said front end of said motor; and a motor mount having a second mounting surface for receiving said first mounting surface, and a base wall having a front surface generally parallel with said second mounting surface, said pilot and said front surfaces having complementary interengaging means for ensuring the proper engagement of said motor and said motor mount.

2. A motor mount assembly according to claim 1, wherein said interengaging means includes at least one protuberance and at least one corresponding recess for receiving said protuberance.

3. A motor mount assembly according to claim 2, wherein said interengaging means on said pilot surface includes said recess.

4. A motor mount assembly according to claim 2, wherein said interengaging means on said front surface of said base wall includes said protuberance.

5. A motor mount assembly according to claim 4, wherein said interengaging means on said pilot surface includes said recess.

6. A motor mount assembly according to claim 1, wherein said recess originates on said pilot surface and extends toward said back end of said motor.

7. A motor mount assembly according to claim 1, wherein said motor mount has a front and a back, said second mounting surface and said base wall are located toward said front, said base wall being oriented such that said front surface is toward said front of said motor mount, and said protuberance extends a length L from said front surface of said base wall away from said back of said motor mount.

8. A motor mount assembly according to claim 7, wherein said recess originates on said pilot surface and extends toward said back end of said motor.

9. A motor mount assembly according to claim 8, wherein said protuberance includes a cavity extending blindly thereinto, said cavity originating on said back of said base surface and extending into said protuberance to a point beyond said front surface of said base wall.

10. A motor mount assembly according to claim 9, wherein said recess extends to a depth sufficient to fully receive said protuberance of said length, L.

11. A motor for use with a hydraulic system of a snowplow, said snowplow being pivotally attached to a structural frame which is rigidly affixed to the exterior of a motorized vehicle, said hydraulic system including a motor mount, said motor having a front and a back, said motor including an end plate at said front, and said end plate and motor mount having complementary interengaging means for ensuring proper engagement between said motor and said motor mount;

said end plate having a mounting surface and a pilot surface extending parallel with said mounting surface, each of said mounting surface and said pilot surface having a periphery, said periphery of said pilot surface being radially inwardly spaced from said periphery of said mounting surface, and said portion of said interengaging means on said motor originating from said pilot surface.

12. A motor according to claim 11, wherein said interengaging means includes at least one recess.

13. A motor according to claim 12, wherein said recess extends into said pilot surface toward said back of said motor.

14. A motor mount for use with a pump of a hydraulic system for a snowplow, said snowplow being pivotally attached to a structural frame which is rigidly affixed to the exterior of a motorized vehicle, said pump having a front and a back, said motor mount being attached at said front of said pump, said motor mount having interengaging means for receiving a motor, and said motor having complementary interengaging means;

said motor mount including a mounting surface and a base wall, each of said mounting surface and said base wall being located toward said front of said motor mount said base wall having a front side and back side and being located on a plane parallel to said mounting surface, each of said mounting surface and said front side of said base wall having a periphery, said periphery of said front side being radially inwardly spaced from said periphery of said mounting surface, said base wall being oriented such that said front side thereof is toward said front of said motor mount, and said protuberance extending from said front side of said base wall toward said mounting surface.

15. A motor mount according to claim 14, wherein said interengaging means of said motor mount includes at least one protuberance.

16. A motor mount according to claim 14, wherein said protuberance includes a cavity blindly extending thereinto, said cavity originating on said back side of said base wall and extending into said protuberance to a point beyond said front side of said base wall.

* * * * *